US006769686B1

(12) United States Patent
Yuge

(10) Patent No.: US 6,769,686 B1
(45) Date of Patent: Aug. 3, 2004

(54) IMAGE FORMING APPARATUS

(75) Inventor: Keiji Yuge, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/388,183

(22) Filed: Mar. 14, 2003

(51) Int. Cl.[7] ..... B65H 29/54; G03G 21/00; G03G 15/20

(52) U.S. Cl. ..... 271/307; 271/312; 271/313; 399/98; 399/323; 399/315; 399/398; 399/399

(58) Field of Search ..... 399/98, 323, 315, 399/398, 399; 271/307, 312, 313

(56) References Cited

U.S. PATENT DOCUMENTS 4,761,667 A * 8/1988 Miyai et al. ..... 399/113
5,138,381 A * 8/1992 Masaki et al. ..... 399/159
5,587,774 A * 12/1996 Nagahara et al. ..... 399/176
5,970,305 A * 10/1999 Shin ..... 399/398

FOREIGN PATENT DOCUMENTS

JP 10-129875 A 5/1998

* cited by examiner

*Primary Examiner*—Andrew H. Hirshfeld
*Assistant Examiner*—Marvin P Crenshaw
(74) *Attorney, Agent, or Firm*—Foley & Lardner LLP

(57) ABSTRACT

There are disposed a star-wheel 21 in the form of a thin wall-thickness having a sharp projecting portion 21*a* as auxiliary member which strips off a recording paper P from the surface of a photosensitive body 2, and an inversion preventing member 22 formed from a synthetic resin sheet having flexibility. The star-wheel 21 is disposed with a spacing between the surface of the photosensitive body 2 and an extreme end of the projecting portion 21*a* held by a fixed distance G. The inversion preventing member 22 has its extreme end placed in contact with the projecting portion 21*a* of the star-wheel 21 so that the star-wheel 21 is not allowed to be rotated in the direction reversed to the direction of rotation where the recording paper P passes through a normal carrying route.

4 Claims, 5 Drawing Sheets

CONDITION①

CONDITION②

CONDITION③

CONDITION④

IMAGE FORMING APPARATUS

BACKGROUND OF THE INVENTION

1. Field of the Invention

The present invention relates to an image forming apparatus employing an electrophotographic system such as a laser printer or an electrophotographic system copying machine, and particularly to an image forming apparatus having no strip-off pawl installed as an auxiliary member which strips off recording media such as a recording sheet or an OHP sheet from the surface of a toner image support body such as a photosensitive body or an intermediate transfer body.

2. Related Art Statement

In an image forming apparatus 1 employing an electrophotographic system such as a laser printer or an electrophotographic system copying machine, as shown in FIG. 1, first, the surface of a photosensitive body 2 is charged to a fixed surface potential by a charger 3, and then, the surface of the photosensitive body 2 is exposed by an exposing device 4 such as a semiconductor laser to attenuate the surface potential, thus forming an electrostatic latent image. Then, a bias voltage is applied to the surface of a developing roller 6 of a developing device 5, a toner charged within the developing device 5 is adhered to an electrostatic latent image forming portion surface of the photosensitive body 2 and developed to form an image, thus displaying a toner image on the surface of the photosensitive body 2.

On the other hand, a recording paper P is taken out of a sheet cassette 7 by a feed roller 8, and carried to a transfer region by a carrying roller 9. In the transfer region, the recording paper P is charged by a transfer charger 10, and the toner image formed on the surface of the photosensitive drum 2 is transferred to the surface of the recording paper P. Next, the recording paper P is stripped off from the surface of the photosensitive body 2 by a strip-off charger 11 and carried to a fixing device 12. And, the toner image is fixed to the surface of the recording paper P by a fixing roller 13, after which it is discharged outside the apparatus by a discharge roller 14.

The toner remained on the surface of the photosensitive body 2 after transfer is cleaned from the surface of the photosensitive body 2 by a cleaning blade 16, is accumulated within a cleaner 15, and afterward, is recovered into a toner waste box.

Incidentally, as a member which strips off the recording paper P after transfer from the surface of the photosensitive body 2, generally, it is often to disposed, in addition to the strip-off charger 11, a strip-off pawl for assisting the former. This strip-off pawl is disposed for the purpose of preventing the recording paper P from being moved into the cleaner 15 erroneously. However, since the pawl is placed in contact with the surface of the photosensitive body 2, it rubs the surface of the photosensitive body 2 at the contact point to wear and damage it results in deterioration, thus possibly lowering the quality of an image.

Therefore, it is sometimes that for the purpose of preventing the recording paper P from being moved into the cleaner 15 without disposing the strip-off pawl, a paper moving-in preventing sheet having an extreme end thereof positioned in the vicinity of the surface of the photosensitive body 2 is disposed. However, when the recording paper P comes in contact with the paper moving-in preventing sheet, a toner not yet fixed is adhered to the paper moving-in preventing sheet, and the toner is adhered to the recording paper P being carried later to produce toner-foul on the surface of the recording paper P.

In view of the foregoing, it is often that in place of the paper moving-in preventing sheet, a star-wheel 21 of thin wall-thickness having a sharp projecting portion 21*a* is disposed as shown in FIG. 2. In the star-wheel 21, since only the projecting portion 21*a* comes in contact with the recording paper P, the toner not yet fixed is not adhered, and no toner-foul occurs on the surface of the recording paper P. Further, when the extreme end of the recording paper P comes in contact, it rotates easily, whereby the transfer of the recording paper P is stabilized, the paper jam and occurrence of creases of the paper surface can be prevented effectively.

The star-wheel 21 is disposed relatively parting from the surface of the photosensitive body 2 as shown in FIG. 2. Where the extreme end of the recording paper P passes through a normal carrying route, as shown by A in FIG. 2, when the extreme end or surface of the recording paper P comes in contact with a sharp projecting portion 21*a* of the star-wheel 21, the star-wheel 21 is easily interlocked and rotated in the direction of A' to carry the recording paper P smoothly.

However, where the situation that the extreme end of the recording paper P passes through the unexpected route, as shown by B in FIG. 2, should occur, the recording paper P is curved or bent and the paper jam would occur. Further, since a recovery plate 17 attached to the cleaner 15 is in contact with the surface of the photosensitive body 2 at an angle for receiving a residual toner into the cleaner 15, the recording paper P tends to move into the cleaner 15 along the surface of the recovery plate 17, and the jam treatment where the recording paper P has been moved in is extremely difficult.

While in the foregoing, a description has been made of the case where the recording paper P is stripped off from the surface of the photosensitive body 2, it is noted that the same is true for the case where the recording paper P is stripped off from the surface of an intermediate transfer body, and is true for the case where recording media other than the recording paper P are stripped off.

SUMMARY OF THE INVENTION

An aspect of the present invention has been accomplished in an attempt of overcoming a conventional problem with respect to an image forming apparatus not provided with a strip-off pawl as an auxiliary member which strips off a recording medium from the surface of a toner image support body, and it is an object of an aspect of the invention to provide an image forming apparatus capable of effectively preventing a recording medium from being moved into a cleaner without occurrence of toner foul on the surface of a recording medium.

For achieving the aforementioned object, the image forming apparatus according to one aspect of the present invention comprises: a star-wheel having a sharp projecting portion, and disposing an auxiliary member which strips off the recording medium with a spacing between the surface of the toner image support body and an extreme end of the projecting portion held by a fixed distance, and an inversion preventing member formed from a synthetic resin sheet having flexibility and in which an extreme end thereof is placed in contact with the projecting portion of the star-wheel so that the start-wheel is not allowed to be rotated in the direction reversed to the direction of rotation where the recording medium passes through a normal carrying route.

DETAILED DESCRIPTION OF THE INVENTION

In the following, an embodiment of the image forming apparatus according to the present invention will be described in detail with reference to the drawings.

Figure 1:
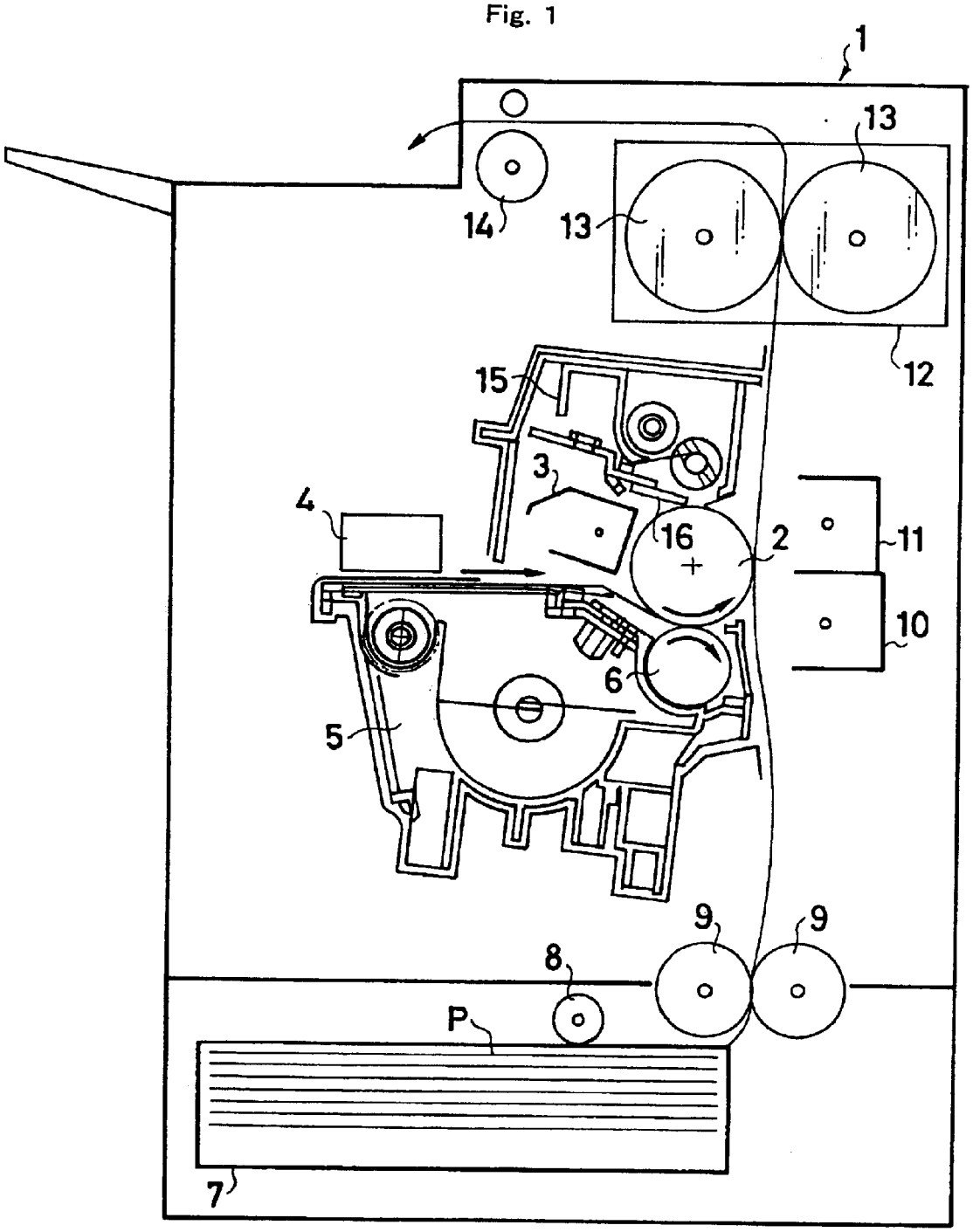
FIG. 1 is a sectional view of main parts of an image forming apparatus employing an electrophotographic system.
Figure 2:
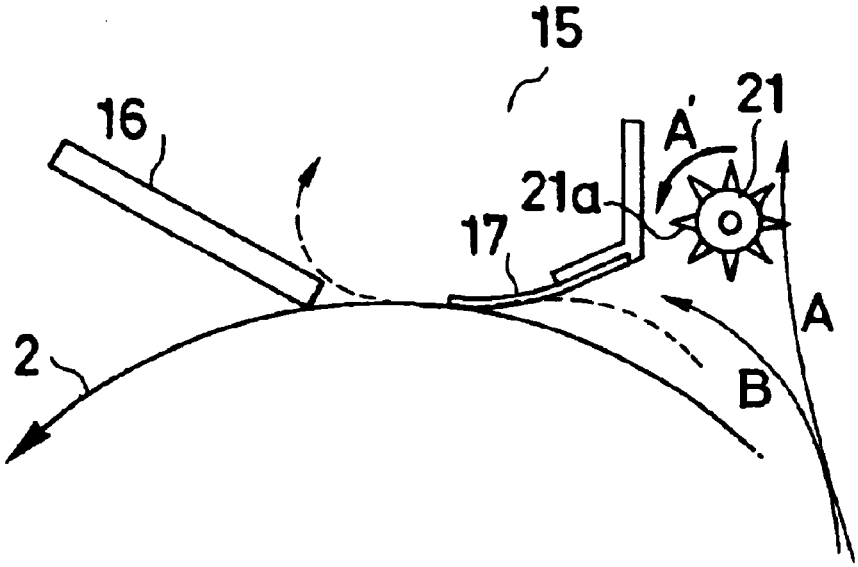
FIG. 2 is an enlarged sectional view showing the neighborhood of a cleaner of the image forming apparatus having a conventional star-wheel disposed.

The image forming apparatus according to the present embodiment comprises, as shown in FIG. 1, similarly to the conventional image forming apparatus 1, a photosensitive body 2, a charging charger 3 for charging the surface of the photosensitive body 2, an exposure device 4 such as a semiconductor laser for irradiating light on the surface of the photosensitive body 2 to form an electrostatic latent image, and a developing roller 6 for supporting and carrying a toner T, and further comprises a developing device 5 for displaying the electrostatic latent image formed on the surface of the photosensitive body, a transfer charger 10 for transferring the toner image formed on the surface of the photosensitive body 2 to a recording paper P, a strip-off charger 11 for stripping off the recording paper P from the surface of the photosensitive body 2, a cleaning blade 16 for cleaning toner remained on the surface of the photosensitive body 2, a recover blade 17 and the like, being constituted by a cleaner 15 for recovering the toner cleaned, an antistatic lamp for discharging a charge remained on the surface of the photosensitive body 2, and the like.

Further, the image forming apparatus according to the present embodiment is also similar to the conventional image forming apparatus 1, in an image forming method, a paper carrying method and the like.

Figure 3:
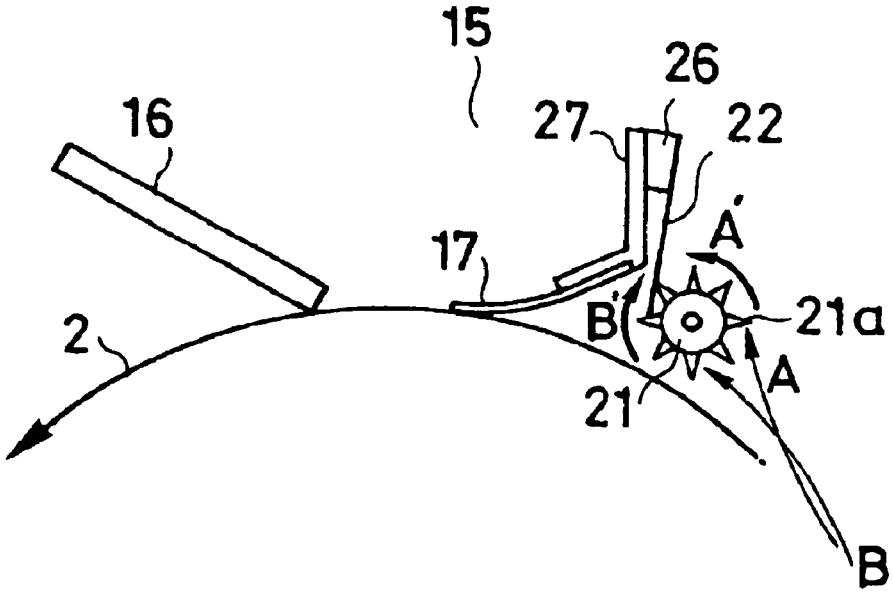
FIG. 3 and FIG. 4 are respectively enlarged sectional views showing the neighborhood of a cleaner of the image forming apparatus having a star-wheel in accordance with one embodiment of the present invention disposed.

On the other hand, the image forming apparatus according to the present embodiment is different from the conventional image forming apparatus 1 in that as an auxiliary member which strips off the recording paper P from the surface of the photosensitive body 2, there are disposed a star-wheel 21 in the form of a thin wall-thickness having a sharp projecting portion 21*a*, and an inversion preventing member 22 formed from a synthetic resin sheet such as polyethylene terephthalate (PET) having flexibility, as shown in FIG. 3.

As shown in FIG. 3, the star-wheel 21 is disposed with a spacing between the surface of the photosensitive body 2 and the extreme end of the projecting portion 21*a* held at a fixed distance, and it rotates easily when the recording paper P comes in contact with the projecting portion 21*a*. In the inversion preventing member 22, the extreme end thereof is placed in contact with the projecting portion 21*a* of the star-wheel 21, and the base end thereof is secured to a side wall surface 27 of the cleaner 15 through a support member 26.

According to such a constitution as described above, as shown by A in FIG. 3, where the extreme end of the recording paper P passes through the normal carrying route, when the extreme end or surface of the recording paper P comes in contact with the sharp projecting portion 21*a* of the star-wheel 21, the projecting portion 21*a* of the star-wheel 21 rubs the surface of the inversion preventing member 22 and the star-wheel 21 can rotate in the direction of A', thus enabling carrying the recording paper P smoothly.

On the other hand, as shown by B in FIG. 3, where the situation occurs such that the extreme end of the recording paper P passes through the unexpected route, even if the extreme end or surface of the recording paper P comes in contact with the projecting portion 21*a* of the star-wheel 21, the projecting portion 21*a* of the star-wheel 21 impinges upon the extreme end of the inversion preventing member 22, and the star-wheel 21 cannot be rotated in the direction of B' (inversion), because of which the recording paper P is curved or bent to produce the paper jam, but the extreme end of the recording paper P is not moved along the surface of the recovery blade 17, and will not be moved into the cleaner 15.

EXAMPLE 1

Figure 4:
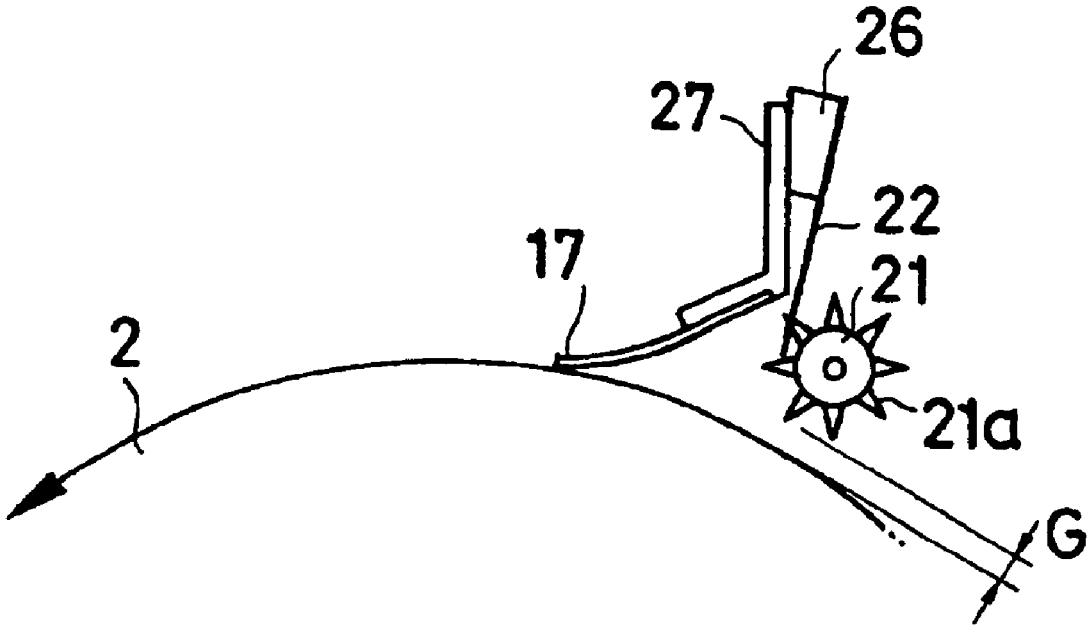

It is assumed that the frequency that the recording paper P is moved into the cleaner 15 to produce the paper jam is affected by a gap G between the surface of the photosensitive body 2 and the extreme end of the projecting portion 21*a* of the star-wheel 21, as shown in FIG. 4.

So, the image forming apparatus is placed under the environmental conditions that temperature is 30° C., and humidity is 85%, the gap G between the surface of the photosensitive body 2 and the extreme end of the projecting portion 21*a* of the star-wheel 21, and images are formed again on the back of 10 recording sheets P with images formed already to check the number of jam occurrences of sheets moved into the cleaner 15.

The results are as shown in Table 1, and it is understood that when the gap G between the surface of the photosensitive body 2 and the extreme end of the projecting portion 21*a* of the star-wheel 21 is set to not more than 0.5 mm (not including 0 mm), no paper jam moved into the cleaner 15 occurs.

TABLE 1

| Star-wheel gap: G | Numb r of jam occurrences (in 10 sheets) |
|---|---|
| 6 mm < G | 7/10 |
| 3.5 mm < G ≦ 6 mm | 2/10 |
| 0 < G ≦ 3.5 mm (FIG. 5, Condition ④) | 0/10 |

EXAMPLE 2

Using the image forming apparatus having various members employed as a member which assists the stripping off of the recording paper P, the frequency of occurrences of the paper jam moved into the cleaner 15 by the strip-off auxiliary member and toner-foul on the surface of recording sheet was confirmed.

Figure 5:
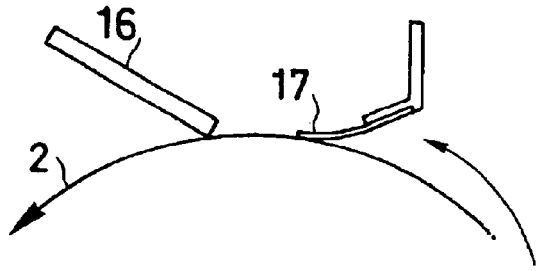
FIG. 5 is an enlarged sectional view showing the neighborhood of a cleaner of the image forming apparatus employing various means as an auxiliary member which strips off a recording sheet of paper.
Figure 5:
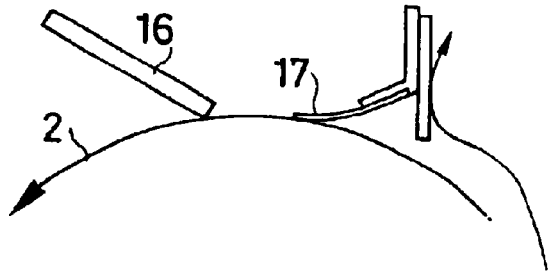
Figure 5:
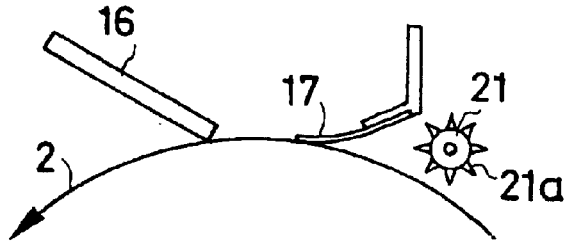
Figure 5:
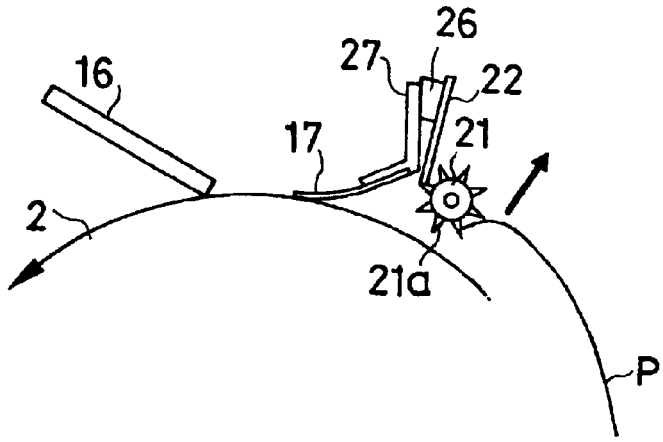

As shown in FIG. 5, as the strip-off auxiliary member, with respect to the respective cases, i.e. ① where nothing is disposed, ② where paper moving-in preventing sheet is disposed, ③ where the star-wheel 21 is disposed, and ④ where the star-wheel 21 and the inversion preventing member 22 are disposed, the image forming apparatus is placed under the environmental conditions that temperature is 30° C., and humidity is 85%, and images are formed gain on the back of 10 recording sheets P with images formed already to check the number of jam occurrences of sheets moved into the cleaner 15. Further, with respect to the above-described respective cases, the image forming apparatus is placed under the environmental conditions that temperature is 10° C., and humidity is 45%, and images are formed again on the back of 10 recording sheets P with images formed already to check the number of toner-foul occurrences on the surface of the recording paper P.

The results are as shown in Table 2. In cases of ① and ③, the sheet jam moved into the cleaner 15 occurs, and in cases of ① and ②, toner foul on the surface of the recording paper P occurs. And, in case of ④, neither sheet jam moved into the cleaner 15 nor toner foul on the surface of the recording paper P occurs, and the recording paper P could be carried satisfactorily.

TABLE 2

| Conditions | High moisture, double-sided copy Jam moved Into cleaner | Low moisture, thin-sheet copy Image foul |
|---|---|---|
| ① | X: 1/10 | Δ: 3/10 |
| ② | 0/10 | Δ: 6/10 |
| ③ | X: 2/10 | 0/10 |
| ④ | 0/10 | 0/10 |

④: Conditions of the present invention
X: Jam which is difficult to stop the main body and to process by user
Δ: Sheet is enabled to feed, but image foul occurs.

Next, one embodiment of the supporting method of the star-wheel 21 and the forming method of the inversion preventing member 22 will be described with reference to FIG. 6 and FIG. 7.

Figure 6:
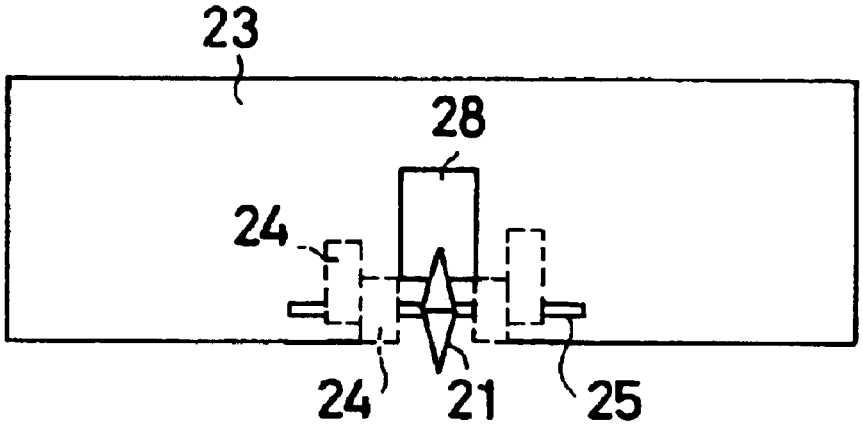
FIG. 6 is a front view of an embodiment in which a star-wheel and an inversion preventing sheet are integrated.
Figure 7:
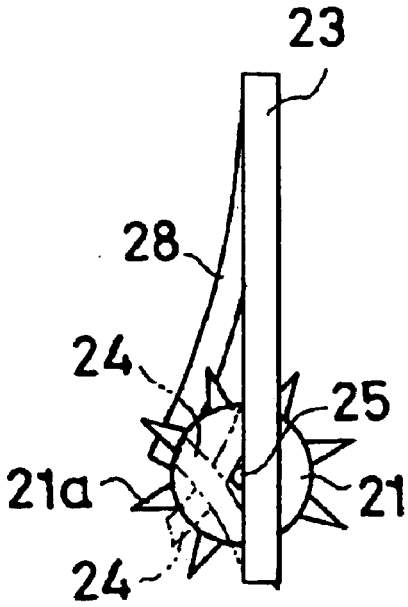
FIG. 7 is a side view in which a star-wheel and an inversion preventing sheet are integrated.

As shown in FIG. 6, a synthetic resin sheet 23 formed of polyethylene terephthalate or the like having flexibility is bored with a cut to form four narrow and short support pieces 24, 24, . . . whose one end is a fixed end and the other end is a free end. As shown in FIG. 4, the adjacent two support pieces 24, 24 are stood upright and curved to hold one end of a support shaft 25 of the star-wheel, and likewise, the adjacent two support pieces 24, 24 are stood upright and curved to hold the other end of the support shaft 25, whereby the star-wheel 21 is supported on the synthetic resin sheet 23.

According to the structure as described above, the number of parts for supporting the star-wheel 21 can be reduced, and as shown in FIGS. 3 to 5, the upper end of the synthetic resin sheet 23 is secured to a side wall surface 27 of the cleaner 15 through a support member 26, whereby the star-wheel 21 can be installed at a fixed position easily.

Further, as shown in FIG. 6, when the star-wheel 21 is supported on the synthetic resin sheet 23, the portion of the synthetic resin sheet 23 where the star-wheel 21 is arranged is bored with a cut which is slightly wider than the wall-thickness of the star-wheel 21 to form a relatively wide inversion preventing piece 28 whose one end is a fixed end and the other end is a free end. Alternatively, as shown in FIG. 7, the inversion preventing piece 28 is stood upright and curved to bring the portion in the vicinity of the free end into contact with the projecting portion 21*a* of the star-wheel 21 so a to provide a function as the inversion preventing member 22.

With the employment of such a structure as described above, a separate part need not be prepared as the inversion preventing member 22, and therefore, the inversion preventing member 22 can be formed simply and inexpensively.

What is claimed is:

1. An image forming apparatus having an auxiliary member not equipped with a strip-off pawl which strips off a recording medium from the surface of a toner image support body, the apparatus comprising:

a star-wheel having a sharp projecting portion, and disposing said auxiliary member which strips off the recording medium with a spacing between the surface of said toner image support body and an extreme end of the projecting portion held by a fixed distance, and an inversion preventing member formed from a synthetic resin sheet having flexibility and in which an extreme end thereof is placed in contact with the projecting portion of said star-wheel so that said start-wheel is not allowed to be rotated in the direction reversed to the direction of rotation where said recording medium passes through a normal carrying route.

2. The image forming apparatus according to claim 1, wherein the spacing between the surface of said toner image support body and the extreme end of the projecting portion of said star-wheel is set to not more than 3.5 mm.

3. The image forming apparatus according to claim 1, wherein a synthetic resin sheet having flexibility is bored with a cut to form a plurality of support pieces whose one end is a fixed end and the other end is a free end, adjacent support pieces are stood upright and curved to hold a support shaft of said star-wheel, whereby said star-wheel is supported on said synthetic resin sheet, and said synthetic resin sheet is secured to a suitable portion, whereby said star-wheel is disposed at a fixed position.

4. The image forming apparatus according to claim 3, wherein when said star-wheel is supported on said synthetic resin sheet, a portion of said synthetic resin where said star-wheel is arranged is bored with a cut which is somewhat wider than the wall-thickness of said star-wheel to form a relatively wide and long inversion preventing piece whose one end is a fixed end and the other end is a free end, and said inversion preventing piece is stood upright and curved to bring a portion in the vicinity of said free end into contact with the projecting portion of said star-wheel, thereby providing a function as said inversion preventing member.

* * * * *